US006035820A

United States Patent [19]

Engelhardt et al.

[11] Patent Number: 6,035,820

[45] Date of Patent: Mar. 14, 2000

[54] ROCKER ARM OR FINGER LEVER FORMED BY A CHIPLESS PROCESS

[75] Inventors: Helmut Engelhardt, Herzogenaurach; Wolfgang Mayer, Seukendorf, both of Germany

[73] Assignee: INA Wälzlager Schaeffler oHG, Herzogenaurach, Germany

[21] Appl. No.: 09/368,807

[22] Filed: Aug. 5, 1999

Related U.S. Application Data

[62] Division of application No. 09/077,238, May 22, 1998.

[30] Foreign Application Priority Data

Nov. 23, 1995 [DE] Germany ..... 195 43 657
May 9, 1996 [WO] WIPO ..... PCT/EP96/01950

[51] Int. Cl.[7] ..... F01L 1/18

[52] U.S. Cl. ..... 123/90.41; 123/90.42; 123/90.44; 74/519; 74/559

[58] Field of Search ..... 123/90.39, 90.41, 123/90.42, 90.43, 90.44, 90.45, 90.46; 74/519, 559, 569

[56] References Cited

U.S. PATENT DOCUMENTS

| | | | |
|---|---|---|---|
| 1,699,657 | 1/1929 | Fagan . | |
| 3,592,174 | 7/1971 | Heidacker | 123/90.35 |
| 4,430,783 | 2/1984 | Wherry | 123/90.39 |
| 4,614,171 | 9/1986 | Malhotra | 123/90.44 |
| 4,628,874 | 12/1986 | Barlow | 123/90.5 |
| 5,010,857 | 4/1991 | Hempelmann et al. | 123/90.39 |
| 5,016,582 | 5/1991 | Mills | 123/90.39 |
| 5,357,917 | 10/1994 | Everts | 123/90.39 |
| 5,582,142 | 12/1996 | Neubrander | 123/90.39 |
| 5,799,546 | 9/1998 | Pryba | 123/90.39 |
| 5,819,694 | 10/1998 | Trutescu et al. | 123/90.39 |

FOREIGN PATENT DOCUMENTS

| | | |
|---|---|---|
| 0 573 674 A1 | 12/1993 | European Pat. Off. . |
| 58-77112(A) | 5/1993 | Japan . |
| 1039895 | 8/1966 | United Kingdom . |

*Primary Examiner*—Weilun Lo
*Attorney, Agent, or Firm*—Akin, Gump, Strauss, Hauer & Feld, L.L.P.

[57] ABSTRACT

A rocker arm or finger lever (1) formed without machining (by a non-cutting shaping process) which has a U-shaped profile in cross section over almost its entire length which is open toward the top or the bottom, whereby the rocker arm or finger lever (1), in its end region in which it contacts a valve shaft end, is constructed double-walled.

This rocker arm or finger lever (1) is distinguished in that the double-walled section or at least a strap (13) projecting over the longitudinal extension of the rocker arm or finger lever (1) is formed on an upper wall (10) which is bent under and lies between its two side walls (11, 12).

A lever configured in this manner can be manufactured economically and has a good rigidity despite the reduced material used.

4 Claims, 5 Drawing Sheets

ROCKER ARM OR FINGER LEVER FORMED BY A CHIPLESS PROCESS

CROSS REFERENCE TO RELATED APPLICATIONS

This application is a divisional of U.S. application Ser. No. 09/077,238, filed May 22, 1998.

BACKGROUND OF THE INVENTION

The invention concerns a rocker arm or finger lever formed by a chipless or non-cutting shaping process from a sheet element which is formed over almost over its entire length into a U-shaped profile which is open toward the top or bottom whereby the rocker arm or finger lever is constructed double-walled in its end area in which it lies against a valve shaft end. Moreover, the invention concerns a further rocker arm or finger lever which, however, does not have a doubled seating surface in the valve-side region.

One such similar formed rocker arm or lever is previously known from U.S. Pat. No. 4,430,783. The double-sided seating surface in the valve-side area is realized in that a second metal strip adapted to the contours of the lever is installed on top of the entire length and joined with the U-shaped body which is open toward the bottom. Here there is the disadvantage that this lever is formed from two parts which must first be assembled together into a unit. A further disadvantage can be seen in that the lever must be constructed very massively and is consequently heavy, that is, it appears to have high inertia forces. A further disadvantage derives from the fact that such a lever possesses a very high side wall alongside the valve bearing surface. Accordingly, a high projecting length of the valve end to the valve spring retainer is also disadvantageous. That is, the overall height of the cylinder head increases, and the valve guide is subjected to greater stress owing to the length of the valve shaft.

Another rocker arm or lever is previously known from DE 41 33 033 A1. The lever shown in FIGS. 3 to 6 has lateral seating surfaces for the valve shaft which arise through a doubled wrapping or folding of the sheet. Due to this type of construction of the lever, however, a larger overall width is brought about disadvantageously. In addition, an increased use of materials goes along which the enlarged overall width, which brings about a larger mass and consequently a greater moment of inertia for the lever.

SUMMARY OF THE INVENTION

The object of the invention is therefore to develop a rocker arm or finger lever which guarantees a low weight and a small breadth with sufficient stability. A further object of the invention is to design such an arm or lever so that it is simple, and can consequently be manufactured economically.

This objective is accomplished in accordance with the invention through the features mentioned below.

In one embodiment, a double-walled section is formed by at least one strap of an upper wall projecting beyond the longitudinal extension of the rocker arm or finger lever, which is bent thereunder and between the two side walls. After the bending process is completed, the bent strap lies between the two side walls and under the upper wall. On the basis of this construction of the lever in the valve-side area, the latter receives a particular stability, while at the same time, in comparison with the previous state of the art, a basic saving in weight is realized because the doubled construction of the bearing surface takes place only in the valve-side area. A further advantage can be seen in that, by bending the strap between the two side walls, the projection between the valve and the valve spring retainer, that is, the overall space, is diminished. Finally, such a lever configured according to the invention is functionally easy to manufacture, because it does not create any problems during the manufacturing process to allow the strap which is subsequently to be bent over or under to remain.

In accordance with a further configuration, the protruding strap is bent 180° parallel to the upper wall, to lie on it, or leaving an intervening free space.

It is provided in a further configuration of the invention that the bent strap is joined fast with the upper wall, for example by welding or soldering. An especially high stability of the lever is reached through this fixed connection.

The strap or straps can be bent in different ways Thus the strap can be bent in the direction of an end region in which the rocker arm or finger lever is braced, or in the direction of an end region in which a valve shaft end lies. It is also possible for one strap to be bent in the direction of one end region and a second strap to be bent in the direction of the other end region.

It is provided according to a the further embodiment that the side walls have one notch each extending to a lower wall, and a rear section arising through the notches is bent below the lower wall, so that a double-walled section including lateral seating surfaces is formed.

Additionally the rear section can be bent 180° parallel to the lower wall, lying upon this or below the lower wall, leaving the intervening space free.

In another aspect, the rear bent section is joined fast with the lower wall by welding or soldering in the manner already described to improve the stability of the lever.

According to another embodiment, it is provided that, in the lateral region of a lower wall or in the area of a lateral wall, straps are formed on each side which project beyond the longitudinal extension of the rocker arm or finger lever, which are bent in the valve-side region under the lower wall so that a lateral seating surfaces is formed. In this way, an especially light lever is provided, which likewise receives its stability through the two bent straps.

According to another aspect of the invention, the straps should be bent 180° parallel to the lower wall and lie upon or below the lower wall, leaving the intervening space free.

As already described above, the bent straps are also joined fast with the lower wall by welding or soldering in this case.

Basically, it is also provided that the straps to be bent are not simply folded, so that a double-walled section arises, but are doubly folded, so that a three-layered section arises.

The invention is explained in greater detail with reference to the embodiments below.

BRIEF DESCRIPTION OF THE DRAWING

The foregoing summary, as well as the following detailed description of preferred embodiments of the invention, will be better understood when read in conjunction with the appended drawings. The drawings are for the purpose of illustrating the present invention which is not limited to the devices and instrumentalities shown.

In the drawings.

DETAILED DESCRIPTION OF THE INVENTION

Figure 1:
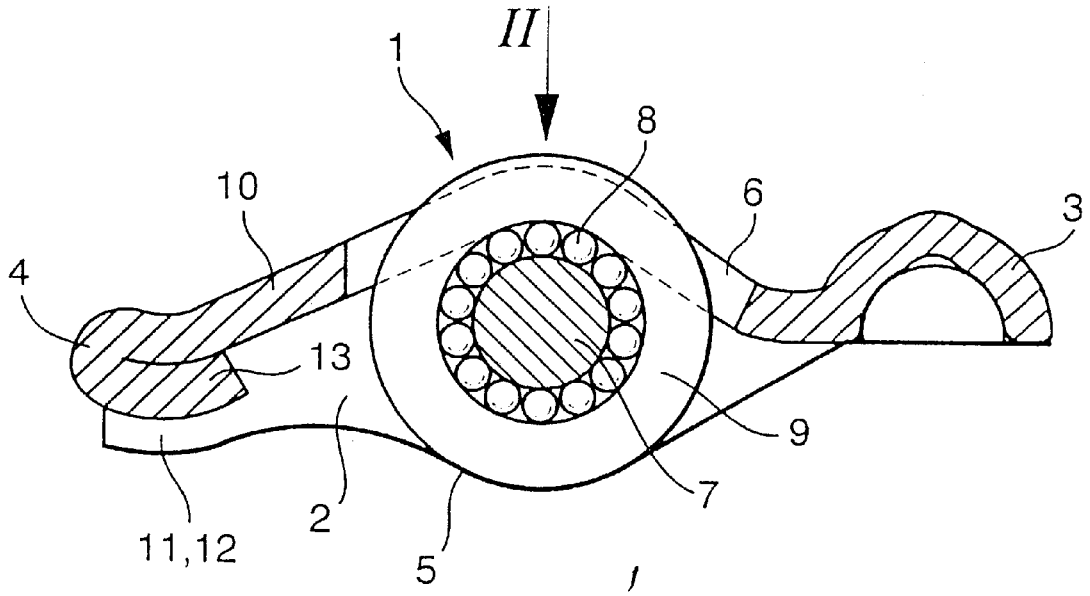
FIG. 1 A side view of a finger lever, partially in section.
Figure 2:
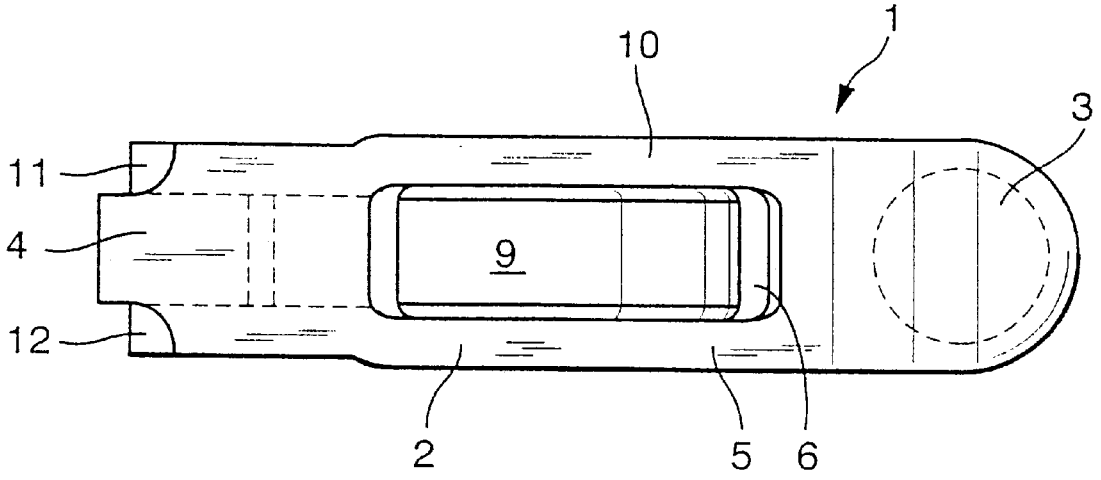
FIG. 2 A top view of a finger lever.
Figure 3:
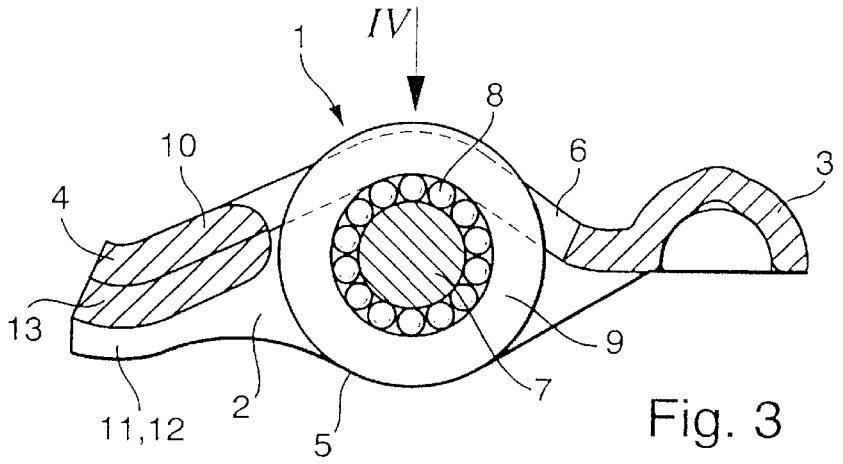
FIG. 3 A side view of a finger lever, partially in section.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the rocker arm or finger lever and designated parts thereof. The terminology includes the words specifically mentioned above, derivatives thereof and words of similar import.

In FIGS. 1 through 4, a finger lever is provided with the reference designation 1 which consists of a metal body 2 constructed in on e piece. The metal body 2 is constructed to have a cross section over almost its entire length in the form of a reversed U. The metal body 2 has an end section 3 which is braced through a bracing element (not represented) on a (likewise not represented) cylinder head. That is, the fulcrum of the finger lever lies on the end section 3. On the other end, the metal body 2 possesses an additional end section 4, which acts upon a valve (likewise not represented). The metal body 2 has a recess 6 in its middle section 5 in which a roller 9 acted upon by a cam (once again not represented) is pivoted on a pin 7 through a needle bearing 8.

The metal body 2 further includes an upper wall 10 and two side walls 11 and 12 extending downward. In the valve-side region, the metal body 2 of the finger lever 1 is provided with a strap 13 which is bent either in the direction of the roller 9 or, according to FIG. 3, away from the roller 9 (in the direction of the end section 4). This strap 13 closely parallels the contour of the upper wall 10, so that in the valve-side region of the drag lever 1, a doubled seating surface for the valve is created, constructed from a part of the upper wall 10 and the strap 13.

Figure 4:
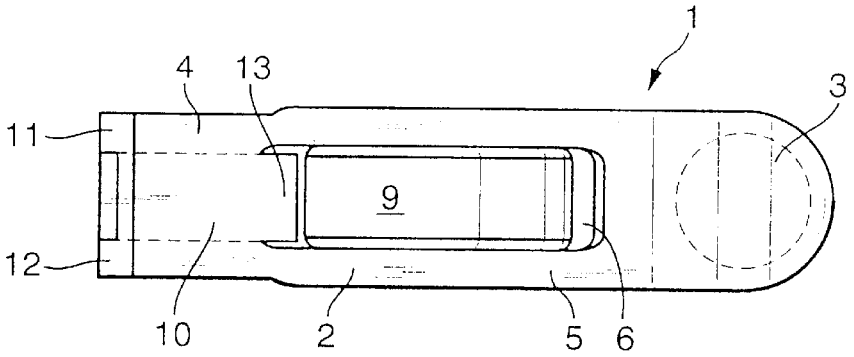
FIG. 4 A top view of a finger lever.
Figure 4A:
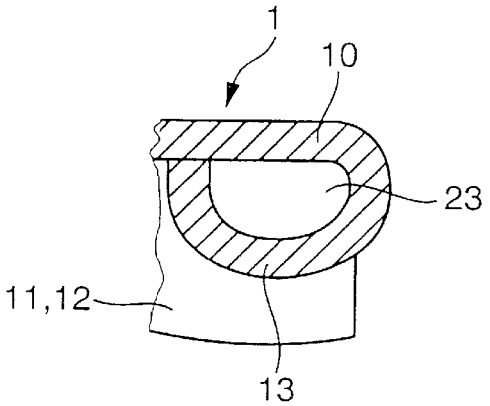
FIGS. 4*a*, 4*b* A section from a side view of a finger lever, partially in section, FIG. 5 A side view of a finger lever, partially in section.
Figure 4B:
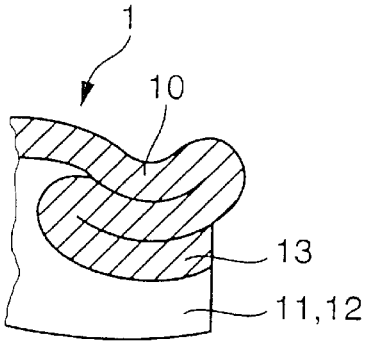
Figure 5:
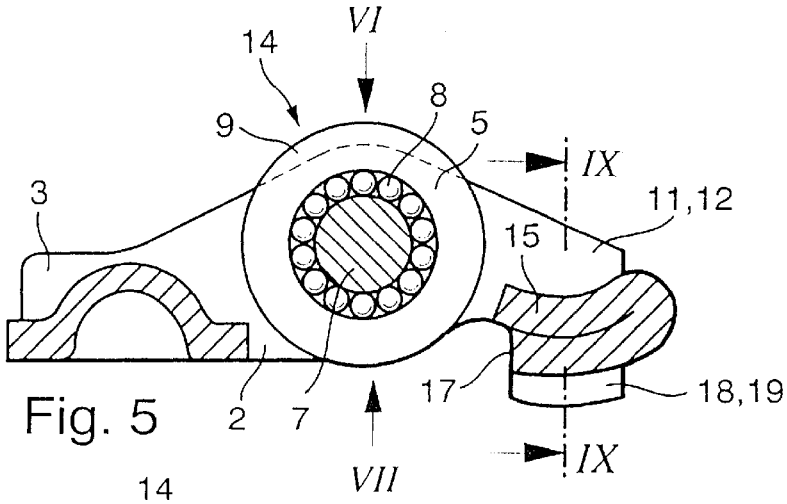
Figure 6:
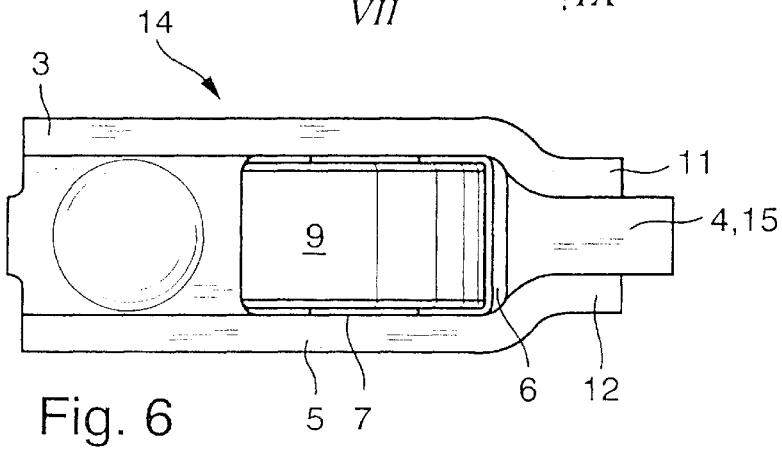
FIG. 6 A top view of a finger lever.
Figure 7:
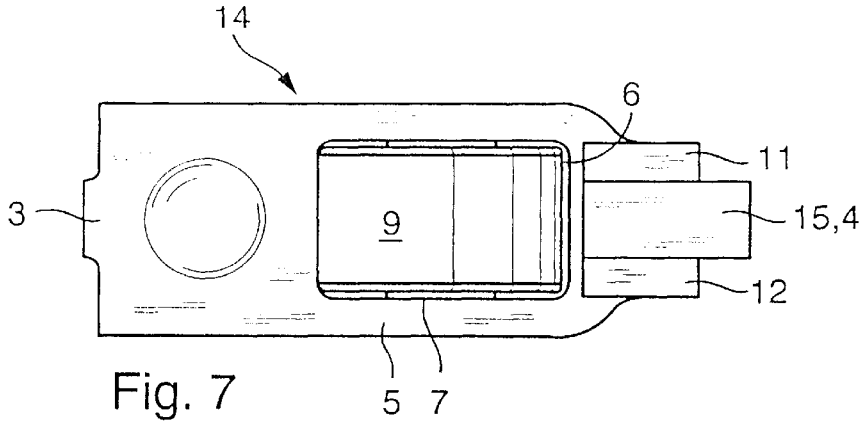
FIG. 7 A bottom view of a finger lever.
Figure 8:
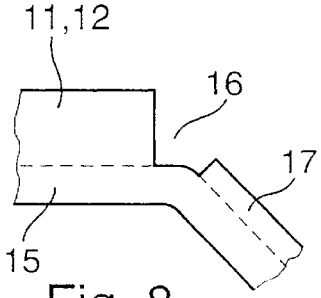
FIG. 8 A section of a side view of a finger lever.
Figure 9:
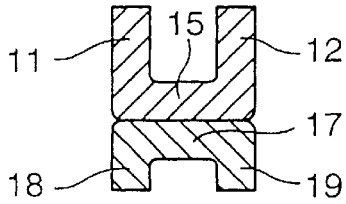
FIG. 9 A transverse section through a finger lever.
Figure 10:
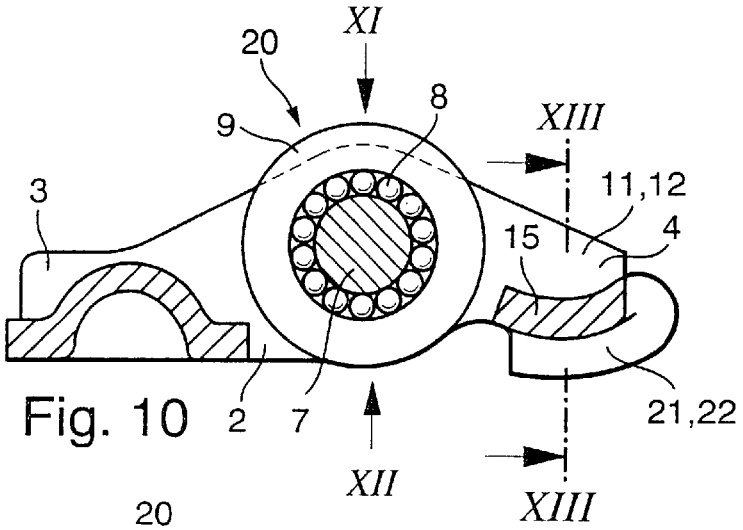
FIG. 10 A side view of a finger lever, partially in section.
Figure 11:
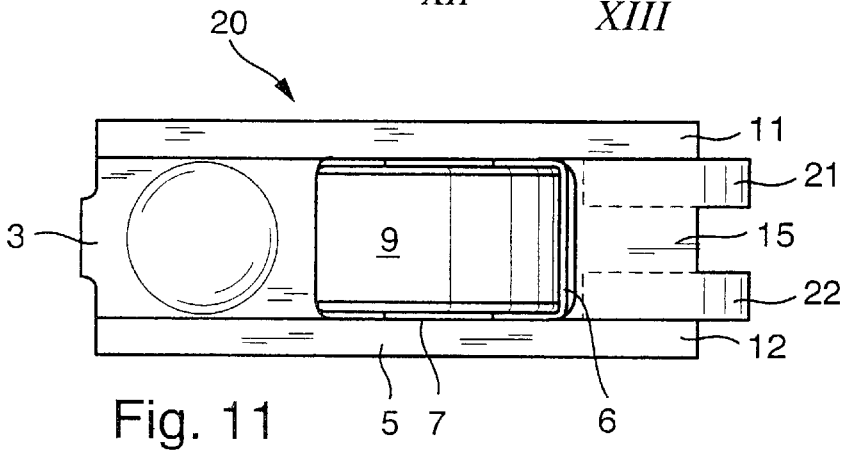
FIG. 11 A top view of a finger lever.
Figure 12:
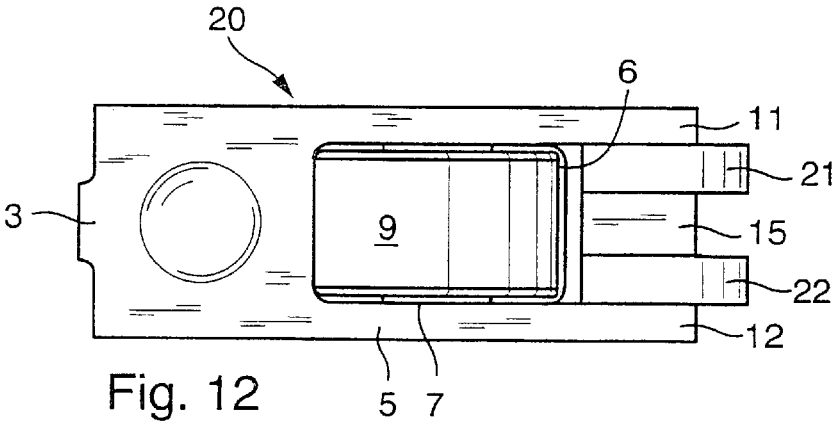
FIG. 12 A bottom view of a finger lever.
Figure 13:
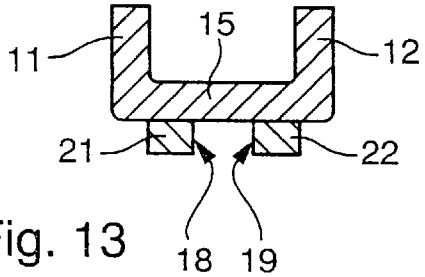
FIG. 13 A transverse section through a finger lever.

The levers 1 represented in FIGS. 4*a* and 4*b* are distinguished in that on the one hand, the strap 13 is bent, leaving an intervening space 23 free below the upper wall 10, and on the other hand, the strap 13 is folded twice, so that a three-layered section is created for seating the valve shaft.

The finger lever 14 represented in FIGS. 5 to 9 is, in contrast with the finger lever 1 represented in FIGS. 1 to 4, constructed U-shaped cross-section of the body facing upward. That is; it possesses a lower wall 15 and two side walls 11 and 12 extending upwardly therefrom. As is especially recognizable from FIG. 8, the side walls 11, 12 are provided with a notch 16 which extends to the lower wall 15, so that a rear section 17 arises. This rear section 17 is also bent 180° parallel to the lower wall 15, so that in the valve-side region, a doubled seating surface is provided with the two lateral seating surfaces 18, 19.

Finally, a finger lever 20 is shown in FIGS. 10 to 13, the lower wall 15 of which possesses straps 21 and 22, each of which extends from its edges in the longitudinal direction of the drag lever 20, that are bent 180° in the manner already described parallel to the lower wall 15 lying below the two side walls 11, 12, so that two lateral seating surfaces 18 and 19 are formed.

Figure 14:
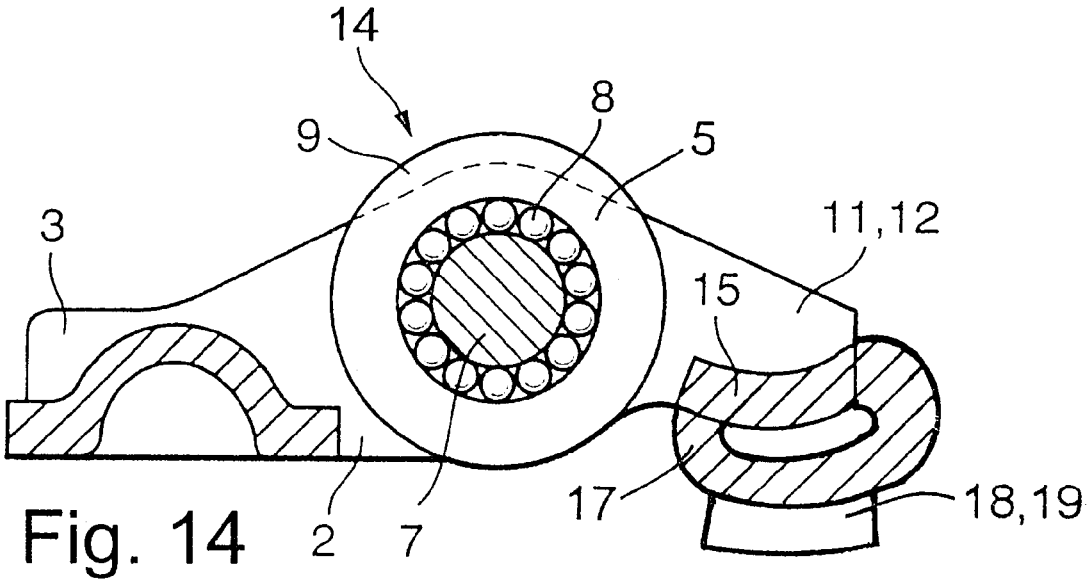
FIG. 14 is a side view of a finger lever, partially in section, similar to FIG. 5.

Referring now to FIG. 14, an alternate embodiment of the finger lever 14 shown in FIGS. 5–9 is provided. In this case, the rear section 17 is bent under the lower portion 15 leaving a free intervening space.

We claim:

1. Rocker arm or finger lever (1) formed without machining from a sheet element, the rocker arm or finger lever comprising a U-shaped profile in cross section having a lower wall (15) and two side walls (11, 12) which extend over a portion of a length of the rocker arm or finger lever from a first end to a second end, the U-shaped profile being open in an upward direction and including an end region (4) at the first end which is adapted to contact a valve shaft end, the end region (4) having a double-walled section, the side walls (11, 12) each including one notch (16) which extends to the lower wall (15) forming a rear section (17) separated by the notches (16), the rear section (17) being bent under the lower wall (15), to form a double-walled section having lateral seating surfaces (18, 19), and a roller being located between the side walls (11, 12) at a middle section between the first and second ends.

2. The rocker arm or finger lever formed without machining according to claim 1, wherein the rear section (17) is bent 180° parallel to and lies on the lower wall (15).

3. The rocker arm or finger lever formed without machining according to claim 1, wherein the rear section (17) is bent under the lower portion (15), leaving a free intervening space.

4. The rocker arm or finger lever formed without machining according to claim 1, wherein the rear bent section (17) is joined with the lower wall (15).

* * * * *